US009783987B2

(12) United States Patent
Gan et al.

(10) Patent No.: US 9,783,987 B2
(45) Date of Patent: Oct. 10, 2017

(54) PRE-TENSIONED CENTRIFUGAL CONCRETE STRUCTURE WITH STEEL STRANDS

(71) Applicant: Xiangyang Yu, Shangyu (CN)

(72) Inventors: Gang Gan, Shangyu (CN); Xiangyang Yu, Shangyu (CN); Kai Zeng, Shangyu (CN)

(73) Assignee: Xiangyang Yu, Shangyu (CN)

( * ) Notice: Subject to any disclaimer, the term of this patent is extended or adjusted under 35 U.S.C. 154(b) by 0 days.

(21) Appl. No.: 15/106,722

(22) PCT Filed: Jan. 19, 2015

(86) PCT No.: PCT/CN2015/000029
§ 371 (c)(1),
(2) Date: Jun. 20, 2016

(87) PCT Pub. No.: WO2015/109930
PCT Pub. Date: Jul. 30, 2015

(65) Prior Publication Data

US 2016/0333583 A1 Nov. 17, 2016

(30) Foreign Application Priority Data

Jan. 24, 2014 (CN) ..... 2014 1 0034851

(51) Int. Cl.
*E04C 3/32* (2006.01)
*E04C 5/12* (2006.01)
(Continued)

(52) U.S. Cl.
CPC ..... *E04C 3/32* (2013.01); *B28B 11/245* (2013.01); *B28B 23/005* (2013.01); *B28B 23/10* (2013.01);
(Continued)

(58) Field of Classification Search
CPC ..... E04C 3/32; E04C 5/122; E04C 5/0618; E04C 5/0631; E04C 3/34; E04C 5/162;
(Continued)

(56) References Cited

U.S. PATENT DOCUMENTS 3,049,775 A * 8/1962 Ondeck ..... E04C 5/122 24/335
3,163,904 A * 1/1965 Ziolkowski ..... E04C 5/122 174/84 S
(Continued)

FOREIGN PATENT DOCUMENTS

CN WO 2017049809 A1 * 3/2017 ..... E02D 5/46

*Primary Examiner* — Rodney Mintz
(74) *Attorney, Agent, or Firm* — Wang Law Firm, Inc.

(57) ABSTRACT

A pre-tensioned centrifugal concrete pillar includes a concrete body, a steel cage including a plurality of pre-stressed rebars, a plurality of stirrups; and two plates, the rebars are steel strands, a plurality of conical through holes are provided on the plate, and multiple clips are disposed inside each conical through hole, each clip having a toothed inner surface, the multiple clips are spliced together to form a chock assembly for clamping each steel strand, and a peripheral surface of the chock assembly has a conical surface; a clamping hole is formed in the center of the chock assembly, the steel strand passes through a clamping hole and is clamped tightly. A method for manufacturing a pre-tensioned centrifugal concrete pillar is also included.

6 Claims, 13 Drawing Sheets

(51) Int. Cl.

| | |
|---|---|
| ***E04C 5/06*** | (2006.01) |
| ***E02D 5/30*** | (2006.01) |
| ***B28B 11/24*** | (2006.01) |
| ***B28B 23/00*** | (2006.01) |
| ***B28B 23/10*** | (2006.01) |
| ***E04C 3/34*** | (2006.01) |
| ***E04C 5/08*** | (2006.01) |
| ***E04C 5/16*** | (2006.01) |

(52) U.S. Cl.
CPC ..... *E02D 5/30* (2013.01); *E04C 3/34* (2013.01); *E04C 5/0618* (2013.01); *E04C 5/0631* (2013.01); *E04C 5/08* (2013.01); *E04C 5/122* (2013.01); *E04C 5/162* (2013.01)

(58) Field of Classification Search
CPC ..... E04C 5/08; B28B 11/245; B28B 23/10; B28B 23/005; E02D 5/30
See application file for complete search history.

(56) References Cited

U.S. PATENT DOCUMENTS 3,382,680 A * 5/1968 Takano ..... E02D 5/523 264/228
3,592,243 A * 7/1971 Fukushima ..... B21F 27/122 140/112
3,716,210 A * 2/1973 Fukushima ..... B21F 27/121 138/176
4,113,823 A * 9/1978 Iida ..... B28B 21/30 138/176
4,166,347 A * 9/1979 Pohlman ..... E04C 3/34 52/223.4
4,405,114 A * 9/1983 Macchi ..... E04G 21/121 254/29 A
4,741,875 A * 5/1988 Carraro ..... B28B 23/10 264/228
5,934,835 A * 8/1999 Whitty, Jr. ..... E02D 5/58 405/232
6,092,341 A * 7/2000 Yamashita ..... E02D 5/30 267/148
6,470,636 B1 * 10/2002 Rose ..... E04C 5/122 52/223.1
6,705,058 B1 * 3/2004 Foust ..... E04C 3/32 52/296
8,375,678 B1 * 2/2013 Ferrer ..... E04C 5/165 52/414
9,677,275 B2 * 6/2017 Stracke ..... E04H 12/16
2003/0000165 A1 * 1/2003 Tadros ..... E04C 3/22 52/223.4
2010/0322717 A1 * 12/2010 Paul ..... E02D 5/105 405/252
2011/0002744 A1 * 1/2011 Tadros ..... E02D 5/523 405/232
2014/0105678 A1 * 4/2014 Lim ..... E04C 5/165 403/342
2014/0223854 A1 * 8/2014 Gilling ..... E04C 5/165 52/745.21
2015/0113913 A1 * 4/2015 Kim ..... E04C 3/34 52/834
2015/0330077 A1 * 11/2015 Stracke ..... E04H 12/16 52/173.1
2017/0191268 A1 * 7/2017 LaFauci ..... E04C 3/34

* cited by examiner

PRE-TENSIONED CENTRIFUGAL CONCRETE STRUCTURE WITH STEEL STRANDS

RELATE APPLICATIONS

This application is a national phase entrance of and claims benefit to PCT Application for Pre-tensioned Centrifugal Concrete Pile Having Steel Strands and Manufacturing Method Thereof, PCT/CN2015/000029, filed on Jan. 19, 2015, which claims benefit to Chinese Patent Application 201410034851.8, filed on Jan. 24, 2014. The specifications of both applications are incorporated here by this reference.

FIELD OF THE INVENTION

The present invention relates to the technical field of pillar foundation projects of various architectural structure systems, and in particular to a pre-tensioned centrifugal concrete pile having steel strands.

DESCRIPTION OF THE PRIOR ART

Various architectural structures usually involve pillar foundation projects. At present, products applied to pillar foundation projects in the market mainly include: bored pillars and pre-tensioned centrifugal concrete pillars (including tubular pillars and square pillars). However, the present economic development and architectural technology have driven the architectural design filed into a new development stage with higher requirements proposed on the pillar foundation. The technical performance of the existing products has fallen short of demands of the architectural market which is developing rapidly, and has manifested many serious technical defects.

The research and production of pre-stressed centrifugal concrete pillars started in 1960s. At the beginning, pre-stressed main rebars of the centrifugal concrete pillars are mainly made of high-strength steel wires. However, high-strength wires, being small in diameter and smooth in circumference, are insufficient in gripping with concrete, and thus cannot meet the architectural requirements in terms of various technical indicators. Till 1980s, steel rebars made of pre-stressed concrete were used as main rebars of pre-stressed centrifugal concrete pillars. Such pre-stressed centrifugal concrete pillars, which have advantages such as high manufacturing efficiency since they are prefabricated in factories, relatively high strength of main rebars, high strength of concrete, convenient for construction, and short cycle, have been greatly and widely applied in the architectural field till now, playing a dominant role in traditional pillar foundation projects at present. However, there are many problems in the centrifugal concrete pillars using steel rebars as main rebars during the production and application process. For example, due to relatively high brittleness and low tensile strength (the tensile strength thereof is designed to be 1000 MPa, and the maximum tensile strength is 1420 MPa) of steel rebars, requirements of the present architectural technology cannot be met. For ease of stretching during the manufacturing process, a process of upsetting steel rebars must be used in which a mushroom-shaped head is formed by thermally upsetting a steel bar so that the upset head is locked with an plate of the pillar body and a tension plate for pre-stressed tensioning. However, since the strength and material quality of the upset head portion will be deteriorated by thermally upsetting the head of a steel bar, and since the upset heads of steel rebars are inconsistent in accuracy, these upset heads cannot be fully contacted with the plate during stretching, leading to partial damage to the plate. Due to insufficient control on the cutting accuracy of steel rebars, these steel rebars are inconsistent in length, and uneven stress or even tensile failure will occur during the tensioning process. In addition, the steel cage is shaped by welding, and the material quality will be deteriorated since the steel rebars are welded at a high temperature. Those defects mentioned above lead to obvious insufficiency in technical performance such as anti-bending, anti-shearing and the like of centrifugal concrete pillars using steel rebars for pre-stressed concrete as main rebars. In engineering application, due to earthquakes, typhoons and other uncertain factors, a relatively large bending moment and horizontal force will be generated in the upper portion of pillar foundation of the building; and due to dynamic load of transport vehicles, a relatively large bending moment and horizontal force will also be generated on road bridges or railway bridges. When those traditional centrifugal concrete pillars mentioned above are applied to those projects mentioned above, those pillars cannot be applied due to insufficiencies in anti-bending and anti-shearing performance, and such insufficiency is particularly obvious in high-rise buildings. In addition, in projects such as foundation pit enclosure and slope retaining and the like, common centrifugal concrete pillars cannot be put into large-scale application due to insufficiency in anti-bending and anti-shearing performance, either. In consideration of safety, in recent years, centrifugal concrete pillars are forbidden to be used in some pillar foundation projects in many regions in China.

Bored pillars, as another kind of pillar body widely applied to building pillar foundation projects, are manufactured by on-site pouring. With regard to the manufacturing procedure thereof, first, a pillar hole is drilled on the construction site; second, a steel cage is put into the pillar hole; then, concrete is poured into the hole. The pillar, after being shaped, can be put into practice when it has been naturally cured for a long time, long enough for it to reach certain strength. Such a pillar body, with a high bearing capacity and ability to be adapted to complicated geological conditions, has a relatively strong vitality. However, during manufacturing process of such bored pillars, slurry pumped to the outside is required to be treated, leading to serious environment pollution. Thus, such pillars are seldom used in urban construction abroad. In addition, in the shaping process of bored pillars, bore walls are likely to collapse and the broken pillars are likely to be sandwiched. If there is a karst cave or a cavity, a large amount of concrete will be wasted. In addition, such pillars have a high construction cost, imposing great influence on the construction cost. Since such pillars are manufactured on site and takes a long period of time for natural curing, those pillars cannot be manufactured in large scale, resulting in low efficiency and long construction period.

Since steel strands have a high tensile strength (the tensile strength thereof is designed to be 1320 MPa, and the maximum tensile strength can reach 1960 MPa), in recent years, corporations and scientific research institutions in China have conducted intensive research on the application of steel strands in centrifugal concrete poles. However, no practical technical solution has been proposed. For example, a Chinese Patent ZL201220238453.6 (Publication No. CN202865836U), titled "TUBULAR PILLAR STEEL CAGE WITH STEEL STRANDS", disclosed such a steel cage in which the steel strands are used in coordination with pre-stressed steel rebars. Since there is a difference between the steel rebars and the steel strands in tensile strength, when an integral pre-stress is imposed simultaneously, tension can be controlled only by the low tensile strength of the steel rebars, and the high tensile strength of the steel strands cannot be displayed. Thus, in this patent, the steel strands play equivalent same role as the steel rebars, and the high tensile strength that steel strands should have is not displayed. If the tensile strength of the steel strands is considered as the control standard, when the steel strands and the steel rebars are integrally tensioned simultaneously, the steel rebars will break. In addition, as this patent does not disclose how the steel strands are connected, fixed and tensioned specifically in the centrifugal concrete pillars, this patent has substantially no practical value and maneuverability in pillar foundation projects.

For another example, a Chinese Invention Patent Application CN1687534A (Appl. No.: CN200510050212.1), titled "PRE-TENSIONED PRE-STRESSED CONCRETE TUBULAR PILLAR WITH STEEL STRANDS", disclosed a concrete tubular pillar having steel strands, wherein steel strands are used as the pre-stressed main rebars thereof, elongated bores are formed on an plate, and the steel strands pass through the elongated bores to form an anchor. However, this patent application does not disclose how steel strands and the plate are connected and anchored specifically in the pre-tensioned centrifugal concrete pillars nor a specific manufacturing method thereof. For a person of ordinary skill in the manufacturing field of concrete pillars, due to a large industry span, generally, they have no idea how to apply the steel strands to the production of pre-tensioned centrifugal concrete pillars. In addition, according to technical solutions described in this patent and the accompanying drawings of the patent application, there is an anchor exposed from an end surface of the shaped pillar body and thus it is impossible to achieve pillar extension. The exposed anchor is likely to break in the piling process. Thus, the pre-stress of the pillar body is damaged and the technical performances thereof such as anti-bending, anti-shearing and the like are deteriorated. Thus, with the technical solution disclosed, such pillars cannot be produced, and cannot be applied to pillar foundation projects even they can be produced. In this patent, a recapitulative technical concept of applying steel strands in the centrifugal concrete pillars is proposed theoretically, and unfortunately, this concept cannot be applied to practical production or construction.

It can be seen from what has been described above that both of the pre-stressed centrifugal concrete pillars using steel rebars as the main rebars and bored pillars widely used in the present market cannot meet requirements of the prior pillar foundation projects, and the pre-tensioned centrifugal concrete pillars using steel strands as main rebars are only a technical concept. It is difficult to firmly fix steel rebars, which are stranded by a plurality of steel rebars and thus difficult to be welded and wound, with a plate or a tension plate and an anchor plate. In view of this, how to connect and fix the steel strands in a pre-tensioned centrifugal concrete pillar and how to tension the steel strand are crucial to manufacture a pre-tensioned centrifugal concrete pillar having steel strands. However, till now, no centrifugal concrete pillar using steel strands as main rebars with practical value in construction has been proposed both in China and abroad.

SUMMARY OF THE INVENTION

A first technical problem to be solved by the present invention is to provide a pre-tensioned centrifugal concrete pillar having steel strands with regard to technical problems in the prior art. With the technical solution, the problem of connecting and fixing steel strands in a pre-tensioned centrifugal concrete pillar is solved, so that it is possible to use steel strands as main rebars inside the centrifugal concrete pillar and this has a practical value in application. Thus, the anti-bending, anti-shearing, and anti-tensioning performance and the like of the centrifugal concrete pillar can be greatly enhanced.

To solve the first technical problem, the pre-tensioned centrifugal concrete pillar having steel strands comprises a hollow concrete body with two ends; a steel cage having an axis and disposed inside the concrete body, the steel cage comprises a plurality of pre-stressed rebars disposed parallel to the axis of the steel cage, a plurality of stirrups placed around the plurality of rebars; and two plates covering the two ends of the body, each plate having an inside facing the body and an outside facing away from the body; wherein, the pre-tensioned pre-stressed rebars are steel strands, and at least one plate is connected to an end of each steel strand through a first clip-type connecting mechanism; the first clip-type connecting mechanism comprises a plurality of conical through holes provided on the plate, each conical through hole having a diameter gradually increasing from the inside toward the outside of the plate, a position of each conical through hole corresponding to each steel strand; and multiple clips disposed inside each conical through hole, each clip having a toothed inner surface; the multiple clips are spliced together to form a chuck assembly for clamping each steel strand, and a peripheral surface of the chuck assembly has a conical surface matching with corresponding conical through hole; a clamping hole is formed in the center of the chuck assembly with the toothed inner surface for receiving and clamping a steel strand, the steel strand passes through a corresponding clamping hole and is clamped tightly; an outer surface of the chuck assembly is flush with or is slightly lower than an outer surface of the plate; and the plate has a plurality of threaded holes for connection.

The expression "multiple" in "multiple clips" mentioned above means two or more.

To solve the first technical problem, another solution is as blow: the pre-tensioned centrifugal concrete pillar having steel strands comprises a hollow concrete body with two ends; a steel cage having an axis and disposed inside the concrete body, the steel cage comprises a plurality of pre-stressed rebars disposed parallel to the axis of the steel cage, a plurality of stirrups placed around the plurality of rebars; and two plates covering the two ends of the body, each plate having an inside facing the body and an outside facing away from the body; wherein, the pre-tensioned pre-stressed rebars are steel strands, and at least one plate is connected to an end of each steel strand through a second clip-type connecting mechanism; the second clip-type connecting mechanism comprises a plurality of counter recesses provided on the plate; a transition element matched with the counter recesses in dimension is disposed inside each counter recess, the transition element having an annular stop shoulder resting on the counter recess and a conical transition through hole, the conical transition through hole having a diameter gradually increasing from the inside toward the outside of the plate and a position of each conical transition through hole corresponding to each steel strand; and multiple clips disposed inside each transition through hole, each clip having a toothed inner surface; the multiple clips are spliced together to form a chuck assembly for clamping each steel strand, and a peripheral surface of the chuck assembly has a conical surface matching with corresponding conical transition through hole; a clamping hole is formed in the center of the chuck assembly with the toothed inner surface for receiving and clamping a steel strand, the steel strand passes through a corresponding clamping hole and is clamped tightly; an outer surface of the chuck assembly is flush with or is slightly lower than an outer surface of the plate; and the plate has a plurality of threaded holes for connection.

Such method is different from the former pre-tensioned centrifugal concrete pillar in that a transition element is arranged inside the plate, and conical through holes are arranged on the transition element; since processing counter recesses is more convenient than processing conical through holes, and processing conical through holes on a transition element is easier than processing conical through holes on an end cap. Meanwhile, the transition element can be made of material having better performance than that of the plate to make the relative fixation between the steel strands and the plate firmer; and threaded holes used for connecting an anchor plate and a tension plate are perforated on the plate.

Preferably, each chuck assembly comprises three clips. It is proved by experiments that each chuck assembly, being constituted of three clips, can have better indicators, and the location of the steel strands and the conical through holes is the firmest. Of course, in practice, a chuck assembly constituted of two clips has good effect too. An annular recess is arranged on the periphery surface of each chuck assembly, and a retention ring placed in the annular recess. The retention ring can be a bead ring or a rubber ring. By providing a retention ring, the chuck assembly constituted of a plurality of clips can be firmer.

Preferably, each end of a steel strand is connected a plate through the second clip-type connecting mechanism, so that both ends of the steel strands can be firmly connected to the plate by a clip-type connecting mechanism. Of course, only one plate can be connected to the steel strands by a clip-type connecting mechanism, and no plate is provided at the other end of the concrete body. During manufacturing, the steel strands at the other end can be connected and fixed for production by other means.

A second technical problem to be solved by the present invention is to provide a method for manufacturing a pre-tensioned centrifugal concrete pillar as described above, including the following steps:

(1) cutting each steel strand into a predetermined length;

(2) manufacturing a steel cage;

(3) inserting each end of each steel strand into a clamping hole of a chuck assembly inside a conical through hole on a plate, or inside a conical transition through hole of a transition element on a corresponding plate;

(4) mounting an anchor plate on an outside of a first of two plates through bolts; or, instead of providing an plate at one end of the steel cage, connecting and fixing the steel strands at this end by other means, for example, fixing the steel strands by the above-mentioned clip-type anchor, mounting a tension plate on an outside of a second of the two plate through bolts, then, putting the steel cage into a lower half-die with a tension plate located in a die cavity of the lower half-die and attaching the anchor plate to an outside surface of one end of the lower half-die;

(5) pouring concrete into the lower half-die, and putting an upper half-die onto the lower half-die;

(6) stretching the steel cage by pulling the tension plate at one end until the steel strand are tensioned to a prescribed numerical value; at the same time, retracting the chuck assemblies towards a small diameter of the conical through holes or the conical transition through hole to make each chuck assembly firmly positioned inside the corresponding conical through hole or the corresponding conical transition through hole, and clamping and locking the end of each steel strand inside the clamping hole;

(7) shaping through rotating by means of centrifugal force;

(8) curing through steaming; and (9) removing the dies, and disconnecting the tension plate and the anchor plate from the corresponding plate to release the tension.

The manufacturing method is so called an integral tensioning method, by which it is possible to manufacture the above-mentioned pre-tensioned centrifugal concrete pillar. In this method, the steps can be well engaged linked, the process is simple and smooth, and the manufacturing cost is low. In addition, step 5 and step 6 can be interchangeably performed.

Preferably, a support plate, a screw stem and a locknut should be used in Step 6, the screw stem has a head and a screw stem portion; the support plate is attached to an outside surface of the other end of the die; the tension plate is connected to the screw stem and the screw stem portion of the screw stem runs through the support plate; the locknut is coupled to the screw stem portion of the screw stem and is located out of the support plate; and then, the screw stem is pulled to pull the tension plate, the plate and the steel strands, until each steel strand is locked by the locknut after being tensioned to a prescribed numerical value.

Preferably, The tension plate and the screw stem can be connected by the following structure: the tension plate has a counter recesses, and the screw stem portion of the screw stem passes through the counter recess on the tension plate from the inside of the steel cage and then passes through the support plate; and the head of the screw stem is located inside the big hole portion of the counter recess on the tension plate.

Preferably, a support plate, a screw stem and a locknut should be used in the tensioning in the step mentioned above. The support plate is attached to an outside surface of the other end of the die; the tension plate has a counter recesses, and the screw stem portion of the screw stem passes through the counter recess on the tension plate from the inside of the steel cage and then passes through the support plate; and the head of the screw stem is located inside the big hole portion of the counter recess on the tension plate; the locknut is coupled to the screw stem portion of the screw stem and is located out of the support plate; and then, the screw stem is pulled to pull the tension plate, the plate and the steel strands, until each steel strand is locked by the locknut after being tensioned to a prescribed numerical value.

Preferably, a pre-tensioning step for pre-tensioning each steel strand is be added between Step 6 and Step 5, the pre-tensioning step is an optional step, and the pre-tensioning step comprises: inserting each steel strand through one of the plurality of bores on the anchor plate; disposing a head portion of a mandrel jack against the outer side surface of the chuck assembly, and inserting the steel strand through the head portion of the mandrel jack, and then connecting the steel strand to a traction portion of the mandrel jack; the steel strand is withdrawn and pre-tensioned to a prescribed numerical value by the traction portion of the mandrel jack so that the steel strand is elongated; then, the mandrel jack is removed, the steel strand retracts back due to own retracting force after being elongated, and meanwhile the chuck assembly is driven to move towards the small diameter of the conical through holes or the conical transition holes, so that the chuck assembly is firmly clamped inside the conical through holes or the conical transition holes, accordingly, the steel strand is further clamped and locked by the clamping hole of the chuck assembly; a Step 10 is added after Step 9, in which the end of each steel strand exposed outside of the plate is cut and polished to make each steel strand not exposed outside of the plate.

Compared with the prior art, the pre-tensioned centrifugal concrete pillar has the following advantages:

The main rebars are all steel strands, so that the main rebars are consistent in tensile strength and the overall performance of the body is greatly enhanced;

The steel strands are fixed with the conical through holes inside the plate by the chuck assembly constituted of clips; by combining the integral tensioning method with single-steel-strand pre-tensioning method, when in pre-tensioning, a mandrel jack is used to resist against the outer end surface of the chuck assembly, and the steel strand is passed through the clamping hole and tensioned in the outer portion by the traction portion of the mandrel jack; after the mandrel jack is removed, the steel strand becomes loose and retracts; due to the retraction of the steel strand, the chuck assembly retracts towards the small diameter of the conical through holes to firmly fix the chuck assembly and the conical through holes, so that the steel strand is further clamped and locked by the clamping hole inside the chuck assembly; then, the screw stem is pulled for integral tensioning, and the steel strand locked by the locknut after being tensioned to a prescribed numerical value; then, centrifugal shaping is performed, and the anchor plate and tension plate are removed after the shaping process to release the tension of the steel strand; and finally, the steel strand exposed from the plate is cut and polished. The manufactured centrifugal concrete pillar, without an anchor portion exposed from the plate, is a practical and feasible centrifugal concrete pillar having steel strands. In addition, the centrifugal concrete pillar is simple and reasonable in the way of connecting and locking the steel strands, convenient in operation and low in cost, so that it is possible to use steel strands in the centrifugal concrete pillar and this have a practical value in industrial application.

The anti-bending, anti-shearing, and anti-tensioning performance of the centrifugal concrete pillar have been greatly enhanced since steel strands with extremely excellent performance have been used in the centrifugal concrete pillar of the present invention.

DETAILED DESCRIPTION OF THE PREFERRED EMBODIMENT

Figure 1:
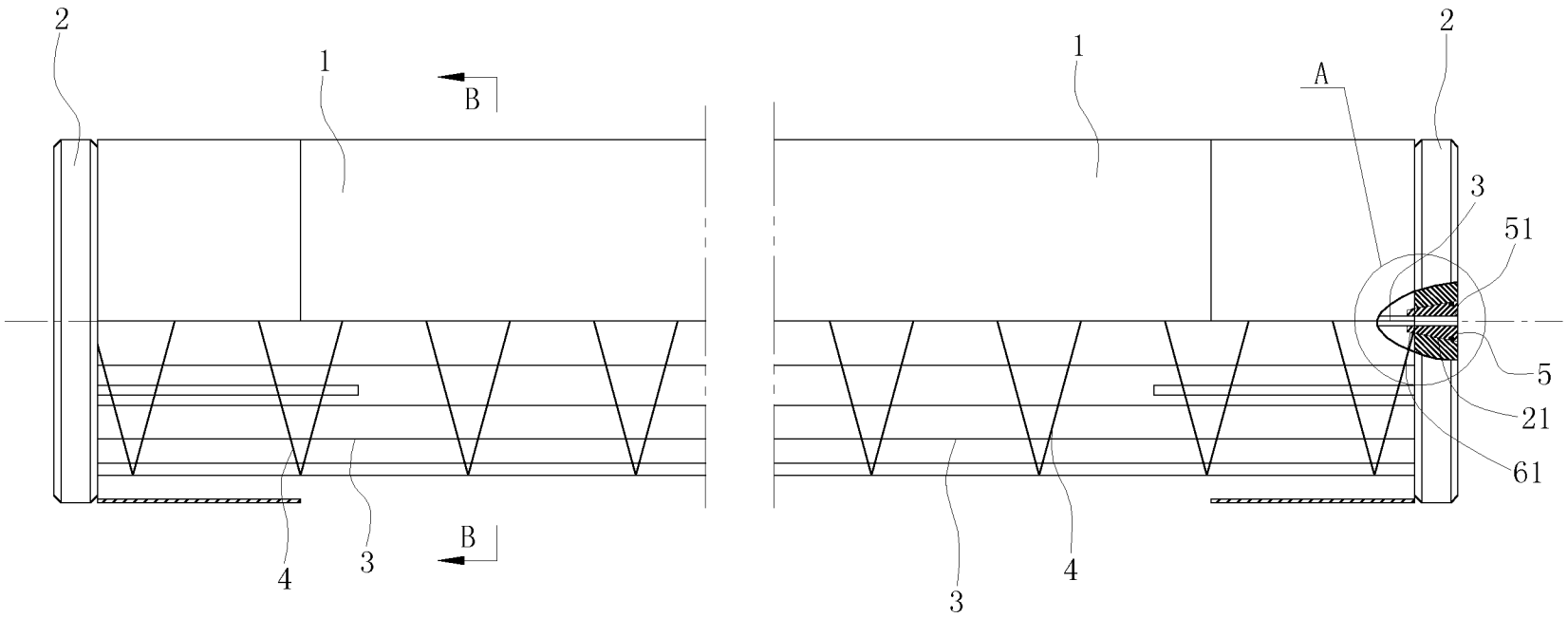
FIG. 1 is a plan view of a pre-tensioned centrifugal concrete pillar according to a first embodiment of the present invention, with a sectional view showing a first clip-type connecting mechanism in the first embodiment.
Figure 2:
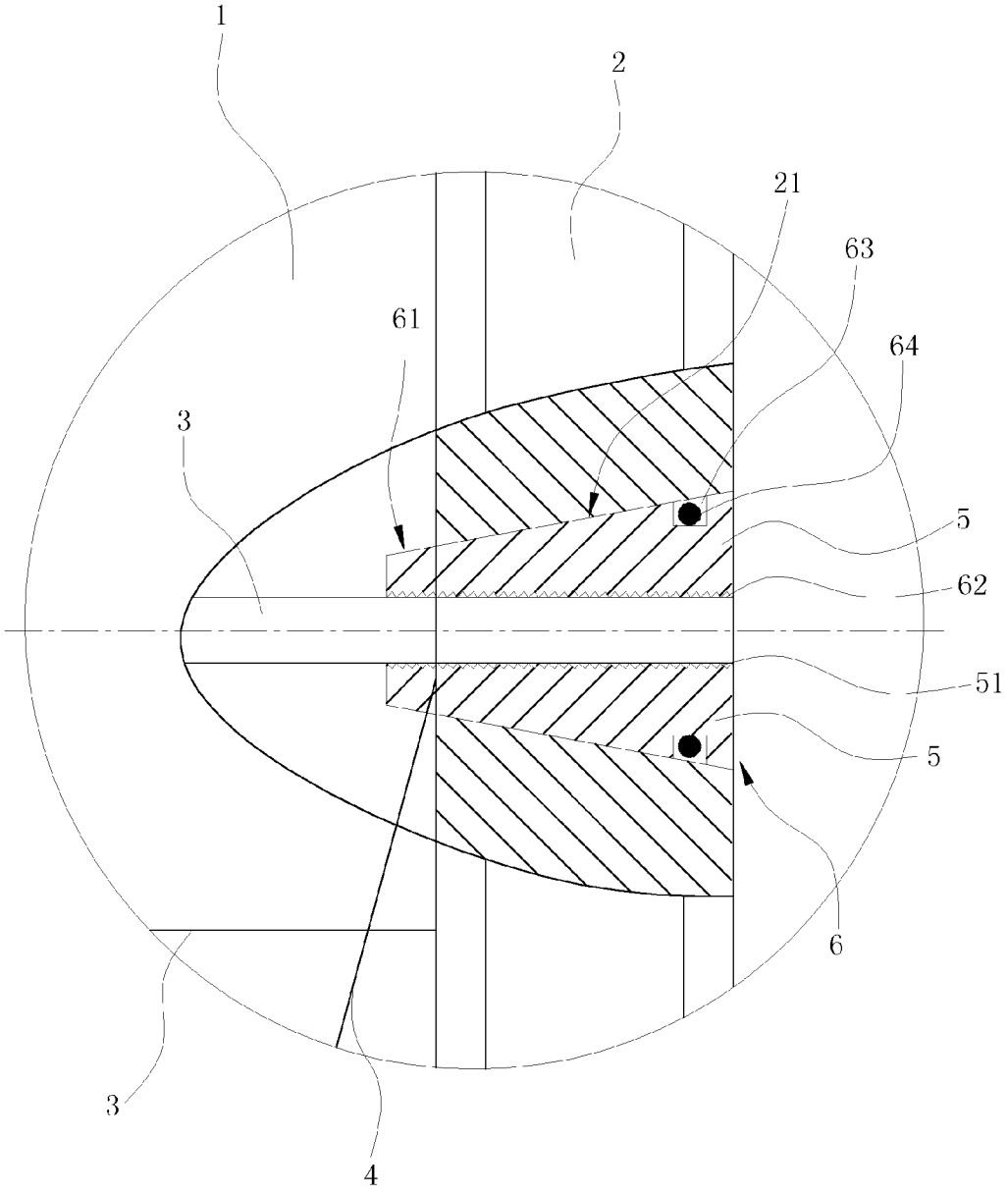
FIG. 2 is an enlarged view of Part-A of FIG. 1.
Figure 3:
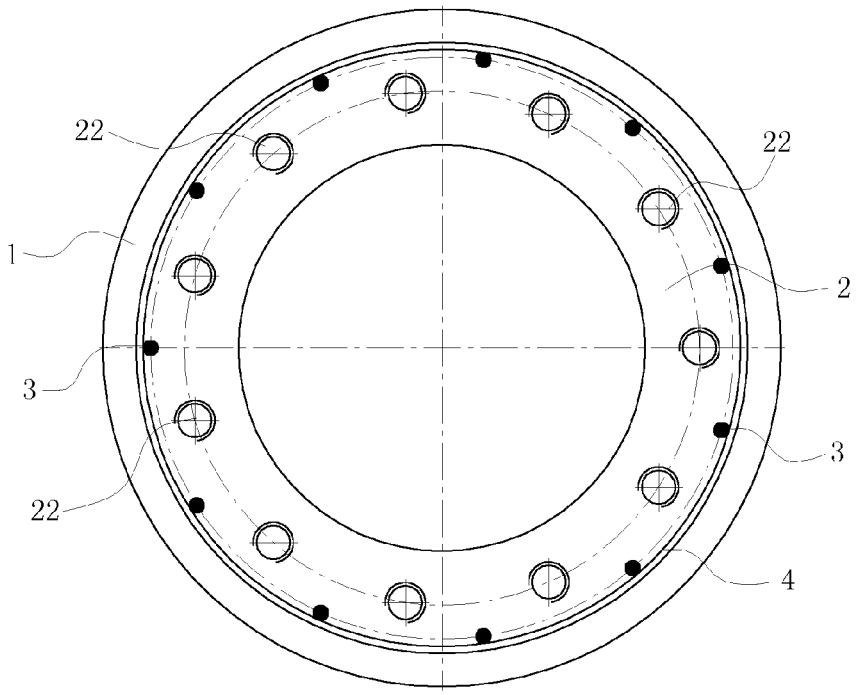
FIG. 3 is a sectional view in B-B direction of FIG. 1.
Figure 4:
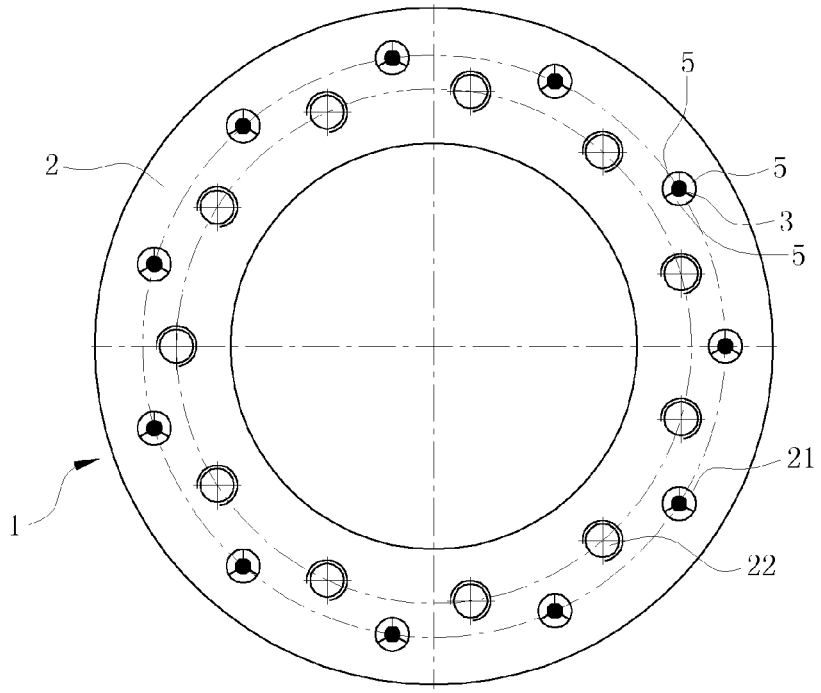
FIG. 4 is a side view of the pre-tensioned centrifugal concrete pillar according to the first embodiment of the present invention.
Figure 5:
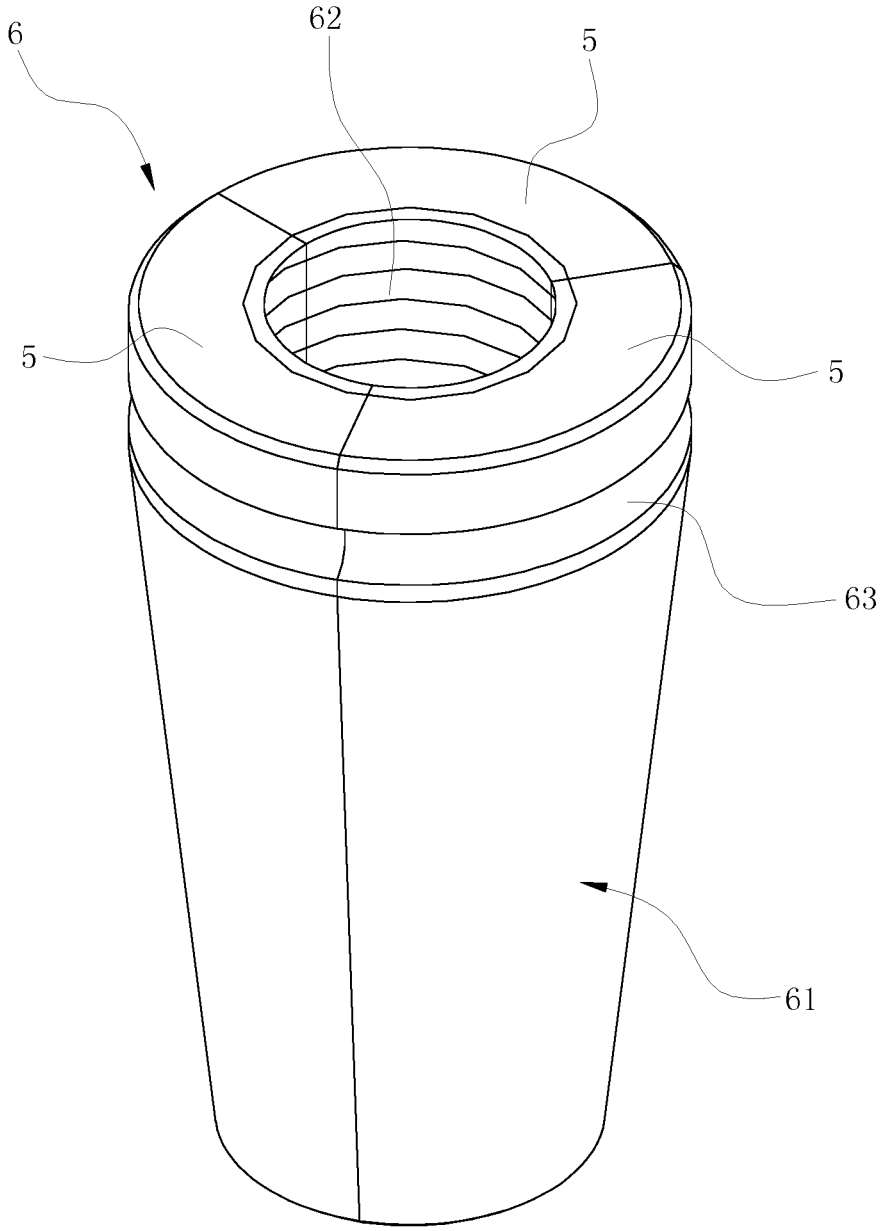
FIG. 5 is a perspective view of a chuck assembly according to the two embodiments of the present invention.
Figure 6:
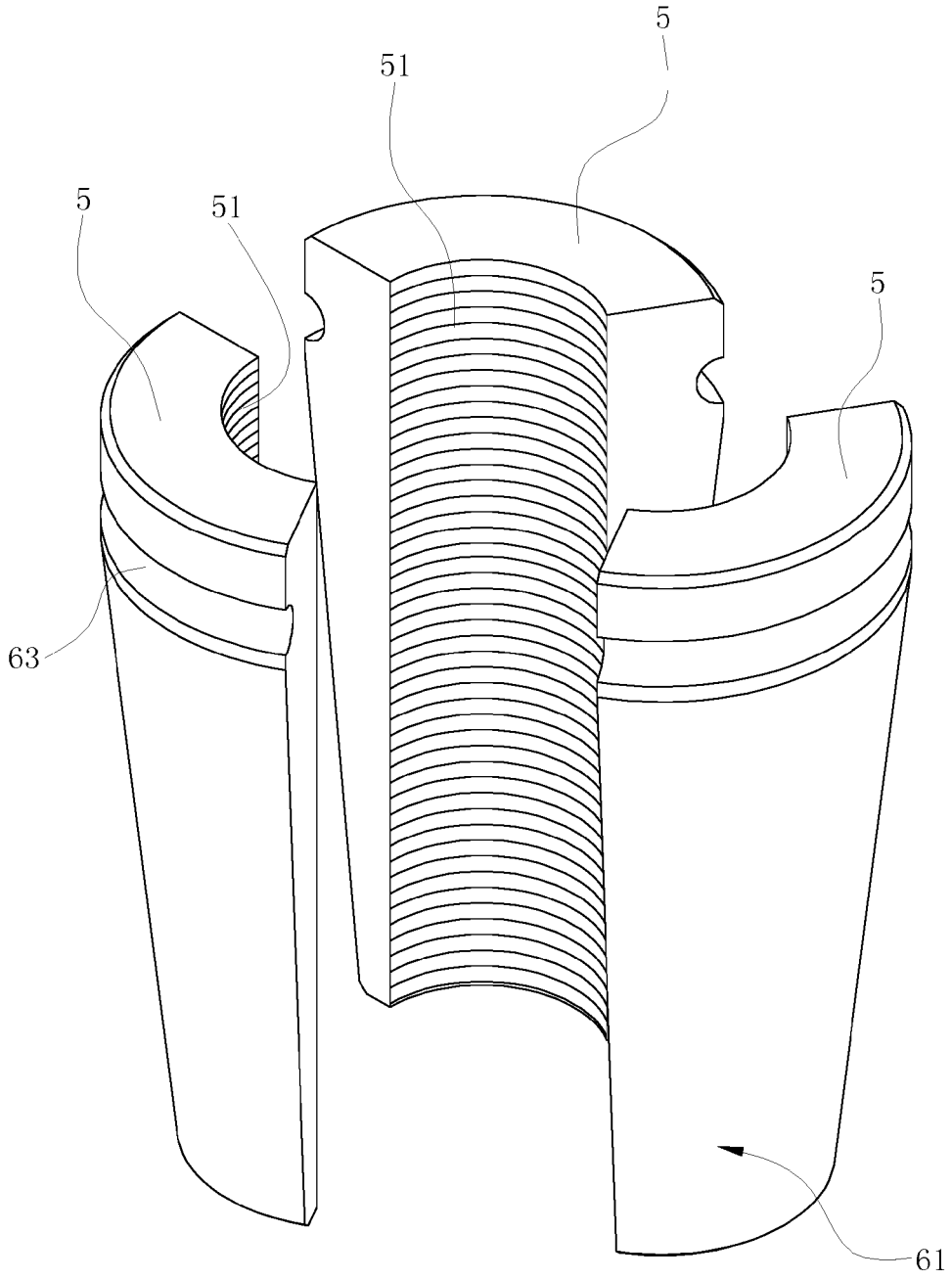
FIG. 6 is an exploded view of the chuck assembly according to the two embodiments of the present invention.

To enable a further understanding of the innovative and technological content of the invention herein refer to the detailed description of the invention and the accompanying drawings below:

FIG. 1 to FIG. 6 show a pre-tensioned centrifugal concrete pillar according to the first embodiment the present invention.

The pre-tensioned centrifugal concrete pillar comprises a hollow concrete pillar body 1 with two ends and a steel cage having an axis and disposed inside the concrete body 1. The body 1 can be a circular pillar, and can also be a square pillar, a polygon pillar and various pre-tensioned centrifugal concrete pillars with special shapes. the steel cage comprises a plurality of pre-stressed rebars disposed parallel to the axis of the steel cage and a plurality of stirrups 4 placed around the plurality of rebars, and the pre-tensioned pre-stressed rebars are steel strands 3. Stirrups 4 and steel strands 3 can be fixed by binding manually or by an automatic binding machine, or can be fixed by other mechanical means. Non-pre-stressed steel rebars, anchor rebars and pillar stirrups can also be arranged in an axial direction on the body 1, and this is a conventional design of centrifugal concrete pillars.

Two plates 2 are connected to an end of each steel strand 3 through a first clip-type connecting mechanism. That is, a plurality of conical through holes 21 provided on the plates 2, each conical through hole has a diameter gradually increasing from the inside toward the outside of the plate 2, a position of each conical through hole corresponds to each steel strand 3; and multiple clips 5 disposed inside each conical through hole 21, each clip 5 having a toothed inner surface 51; each chuck assembly 6 comprises three clips 5, an annular recess 63 is formed on the periphery surface of each chuck assembly 6, and a retention ring 64 placed in the annular recess 63.

A peripheral surface of the chuck assembly 6 has a conical surface 61 matching with corresponding conical through hole 21; a clamping hole 62 is formed in the center of the chuck assembly 6 with the toothed inner surface for receiving and clamping a steel strand 3, the steel strand 3 passes through a corresponding clamping hole 62; after the steel strands 3 are tensioned and then loosened, due to the retraction of steel strands 3, the steel strands 3 are clamped and locked tightly by the clamping hole 62 inside the chuck assembly; and meanwhile, also due to the retraction of the steel strands 3, the chuck assembly 6 retracts towards the small diameter of the conical through holes 21 so that the chuck assembly 6 is firmly fixed with the conical through hole 21. An outer surface of the chuck assembly 6 is flush with or is slightly lower than an outer surface of the plate 2.

The plate 2 has a plurality of threaded holes 22 for connecting an anchor plate or a tension plate.

The main rebars are all steel strands 3, and the steel strands 3 are fixed with the conical through holes 21 inside the plate 2 by the chuck assembly 6 constituted of clips 5. When the integral tensioning is performed, a mandrel jack is used to resist against a support plate, and then a screw stem is used for pulling the tension plate and the tension plate is pre-tensioned to a prescribed numerical value and locked by a locknut. This is a conventional tensioning method for a centrifugal pillar. By combining the integral tensioning method with single-steel-strand pre-tensioning method, when a single steel strand is pre-tensioned, a mandrel jack can be deposed to resist against the outer side surface of the chuck assembly 6, and the steel strand 3 is inserted through the clamping hole 62. The steel strand 3 is tensioned by the traction portion of the mandrel jack on the outside, and when the mandrel jack is removed, the steel strand 3 retracts back, and meanwhile the chuck assembly 6 is driven to move towards the small diameter of the conical transition holes 72, so that the chuck assembly 6 is firmly clamped inside the conical transition holes 72, accordingly, the steel strand 3 is further clamped and locked by the clamping hole 62 of the chuck assembly 6; then, the integral tensioning is performed; then, centrifugal shaping is performed, and the anchor plate and tension plate are removed after the shaping process to release the tension of the steel strand 3; and finally, the steel strand 3 exposed from the plate 2 is cut and polished. The manufactured centrifugal concrete pillar, without an anchor portion exposed from the end portion, is a practical and feasible centrifugal concrete pillar having steel strands. In addition, the centrifugal concrete pillar is simple and reasonable in the way of connecting and locking the steel strands, convenient in operation and low in cost, so that it is possible to use steel strands in the centrifugal concrete pillar and this have practical value in industrial application. The anti-bending, anti-shearing, and anti-tensioning performance of the centrifugal concrete pillar have been greatly enhanced since steel strands with extremely excellent performance have been used in the centrifugal concrete pillar of the present invention.

Figure 7:
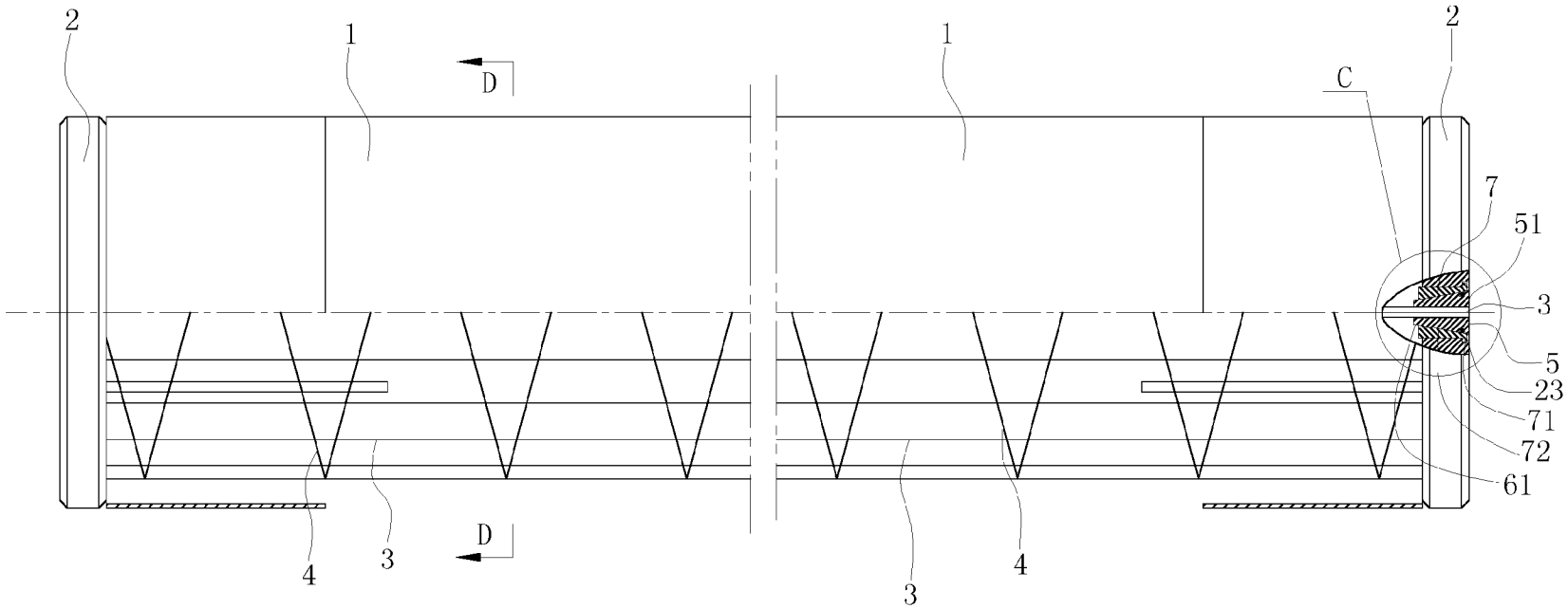
FIG. 7 is a plan view of a pre-tensioned centrifugal concrete pillar according to a second embodiment of the present invention, with a sectional view showing a second clip-type connecting mechanism in the second embodiment.
Figure 8:
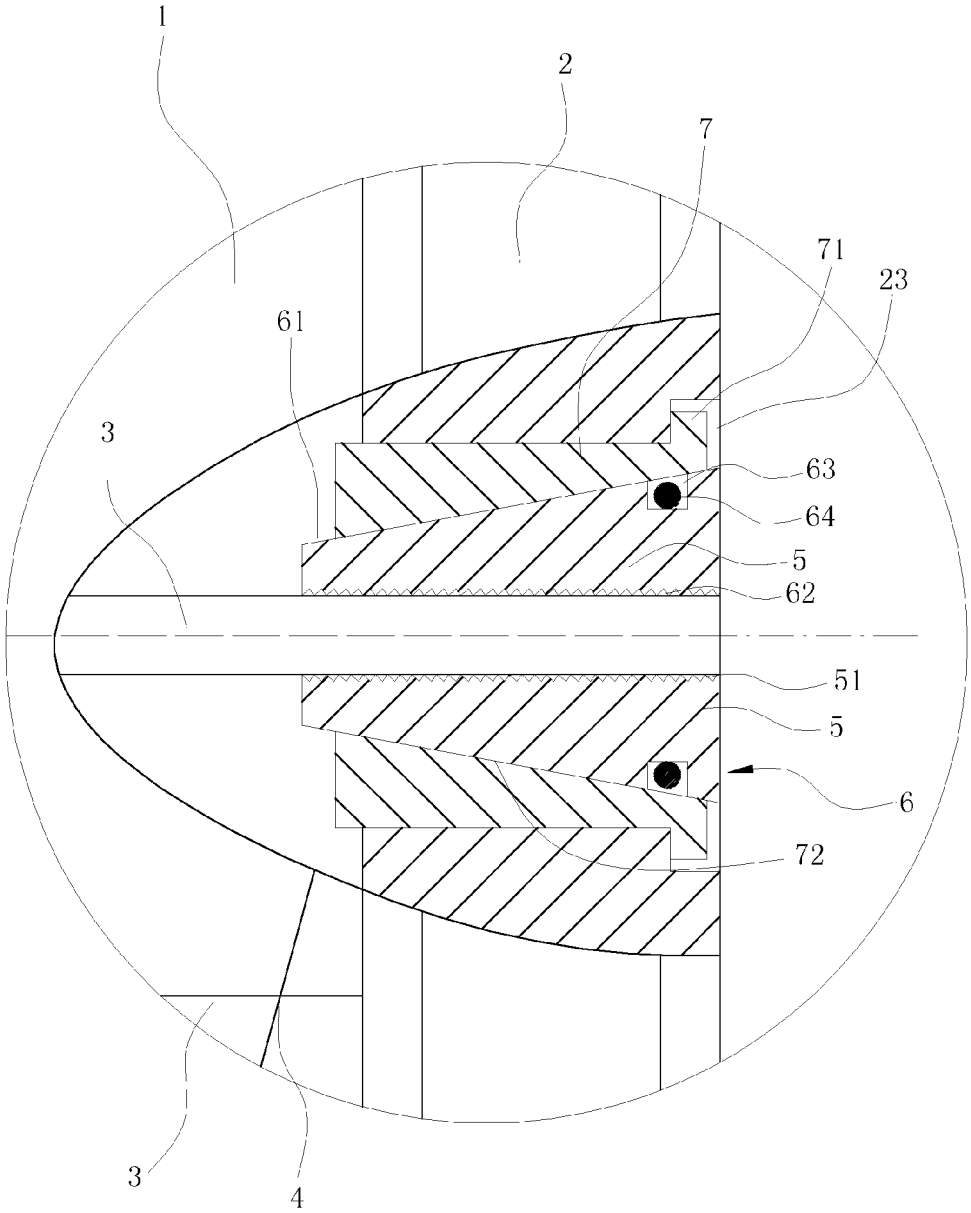
FIG. 8 is an enlarged view of Part-C of FIG. 7.
Figure 9:
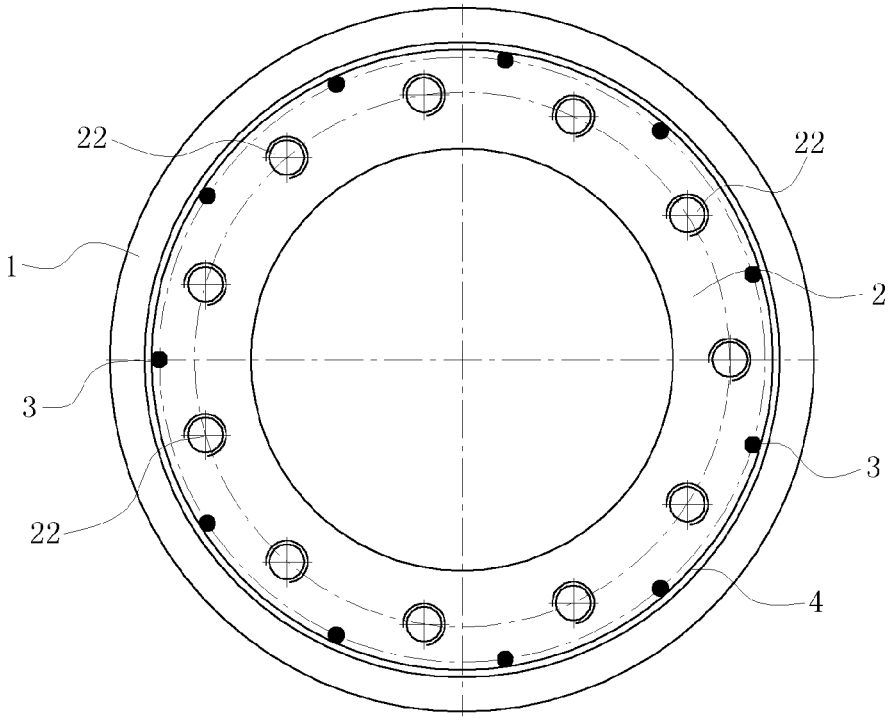
FIG. 9 is a sectional view in D-D direction of FIG. 7.
Figure 10:
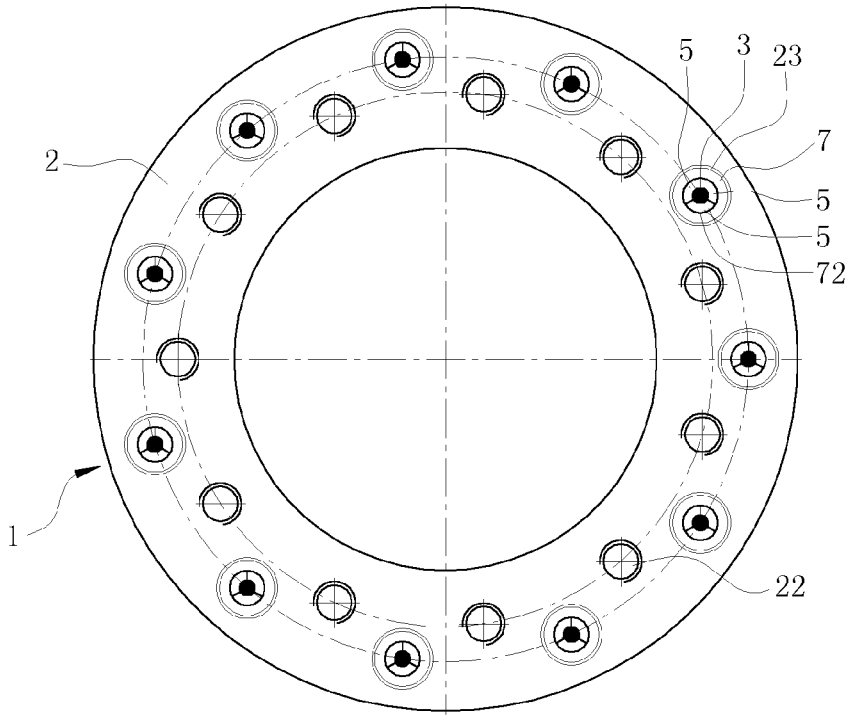
FIG. 10 is a side view of the pre-tensioned centrifugal concrete pillar according to the second embodiment of the present invention.

FIG. 5 to FIG. 10 show a pre-tensioned centrifugal concrete pillar according to the second embodiment of the present invention.

In this embodiment the differences from the first embodiment is as below: two plates 2 are connected to an end of each steel strand 3 through a second clip-type connecting mechanism; a plurality of counter recesses 23 are provided on the plates 2; a transition element 7 matched with the counter recesses 23 in dimension is disposed inside each counter recess 23, the transition element has an annular stop shoulder 71 resting on the counter recess 23 and a conical transition through hole 72, the conical transition through hole has a diameter gradually increasing from the inside toward the outside of the plate 2 and a position of each conical transition through hole corresponds to each steel strand 3; and multiple clips 5 disposed inside each transition through hole 72, each clip 5 having a toothed inner surface 51; the multiple clips 5 are spliced together to form a chuck assembly 6 for clamping each steel strand 3, and a peripheral surface of the chuck assembly 6 has a conical surface 61 matching with corresponding conical transition through hole 72; a clamping hole 62 is formed in the center of the chuck assembly 6, the steel strand 3 passes through a corresponding clamping hole 62; after the steel strand 3 is tensioned and becomes loose, due to the retraction of the steel strand 3, the steel strand 3 is clamped and locked tightly by the clamping hole inside the chuck assembly; and also due to the retraction of the steel strand 3, the chuck assembly 6 is driven to move towards the small diameter of the conical transition through holes 72, so that the chuck assembly 6 is firmly clamped inside the conical transition through holes 72; and meanwhile, the transition element 7 is driven to move backward so that the annular stop shoulder 71 on the transition element 7 is tightly bonded to the big hole portion of the counter recess 23. The outer end surface of the chuck assembly 6 is flush with or is slightly lower than an outer surface of the plate.

The main rebars are all steel strands 3, and the steel strands 3 are fixed with the conical transition through holes 72 inside the plate 2 by the chuck assembly 6 constituted of clips 5. When the integral tensioning is performed, a mandrel jack is used to resist against a support plate, and then a screw stem is used for pulling the tension plate, and the tension plate is pre-tensioned to a prescribed numerical value and locked by a locknut. This is a conventional tensioning method for a centrifugal pillar. By combining the integral tensioning method with single-steel-strand pre-tensioning method, when a single steel strand is pre-tensioned, a mandrel jack can be deposed to resist against the outer side surface of the chuck assembly 6, and the steel strand 3 is inserted through the clamping hole 62. The steel strand 3 is tensioned by the traction portion of the mandrel jack on the outside, and when the mandrel jack is removed, the steel strand 3 retracts back, and meanwhile the chuck assembly 6 is driven to move towards the small diameter of the conical transition holes 72, so that the chuck assembly 6 is firmly clamped inside the conical transition holes 72, accordingly, the steel strand 3 is further clamped and locked by the clamping hole 62 of the chuck assembly 6; and meanwhile, the transition element 7 is driven to move backward so that the annular stop shoulder 71 on the transition element 7 is tightly bonded to the big hole portion of the counter recess 23; then, the integral tensioning is performed; then, centrifugal shaping is performed, and the anchor plate and tension plate are removed after the shaping process to release the tension of the steel strand 3; and finally, the steel strand 3 exposed from the plate 2 is cut and polished. The manufactured centrifugal concrete pillar, without an anchor portion exposed from the end portion, is a practical and feasible centrifugal concrete pillar having steel strands. In addition, the centrifugal concrete pillar is simple and reasonable in the way of connecting and locking the steel strands, convenient in operation and low in cost, so that it is possible to use steel strands in the centrifugal concrete pillar and this have a practical value in industrial application. The anti-bending, anti-shearing, and anti-tensioning performance of the centrifugal concrete pillar have been greatly enhanced since steel strands with extremely excellent performance have been used in the centrifugal concrete pillar of the present invention.

The centrifugal concrete pillar having steel strands provided by the present invention can be used as a pole body of a telegraph pole, as a ground support pole for a telecom base station and for a wind power generation system, and as a support for other ground construction projects. Such a pillar has a wide application range.

Figure 11:
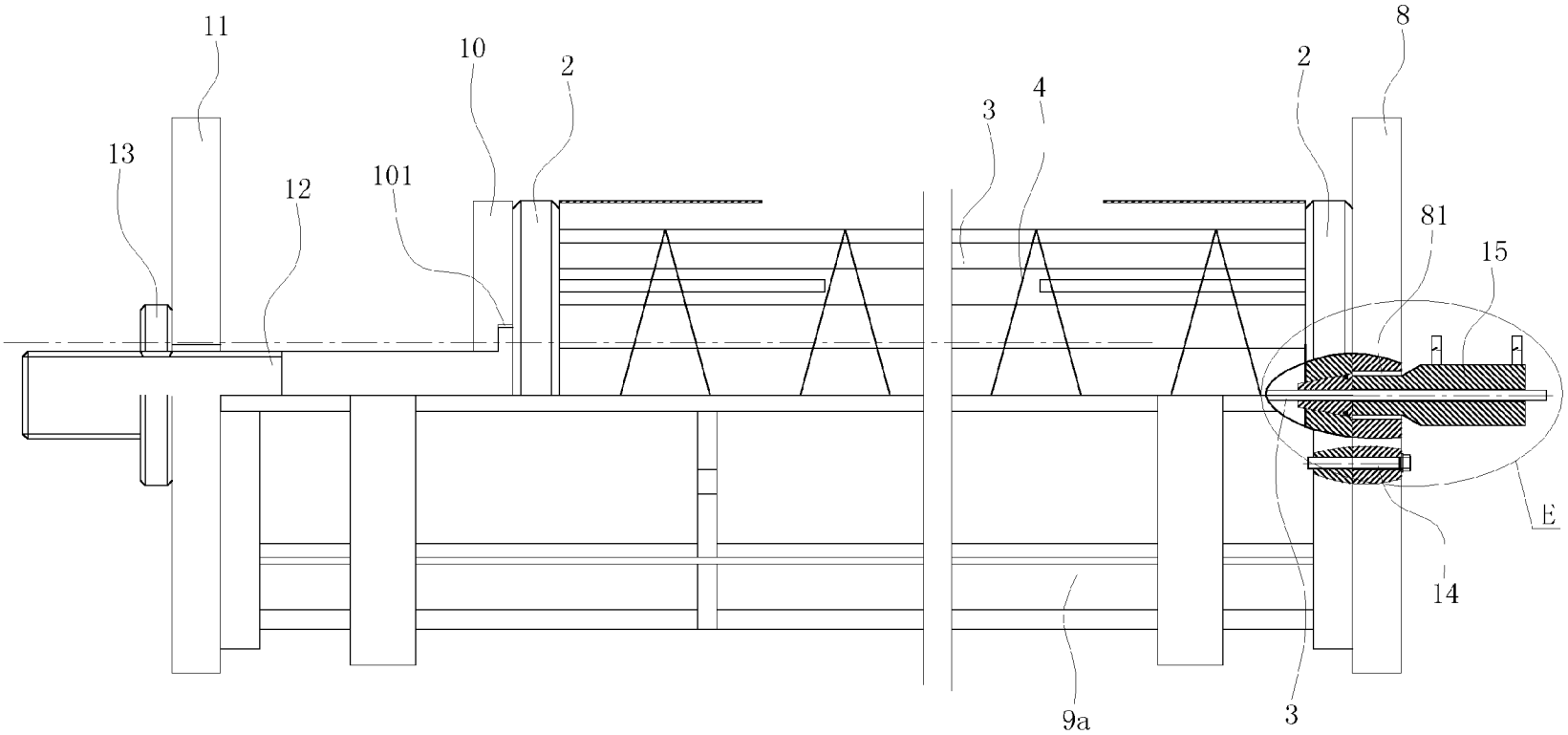
FIG. 11 is a plan view of a method for manufacturing the pre-tensioned centrifugal concrete pillar according to the first embodiment of the present invention mentioned above (with the upper half-die removed), with a sectional view showing the position of the first clip-type connecting mechanism in the first embodiment.
Figure 12:
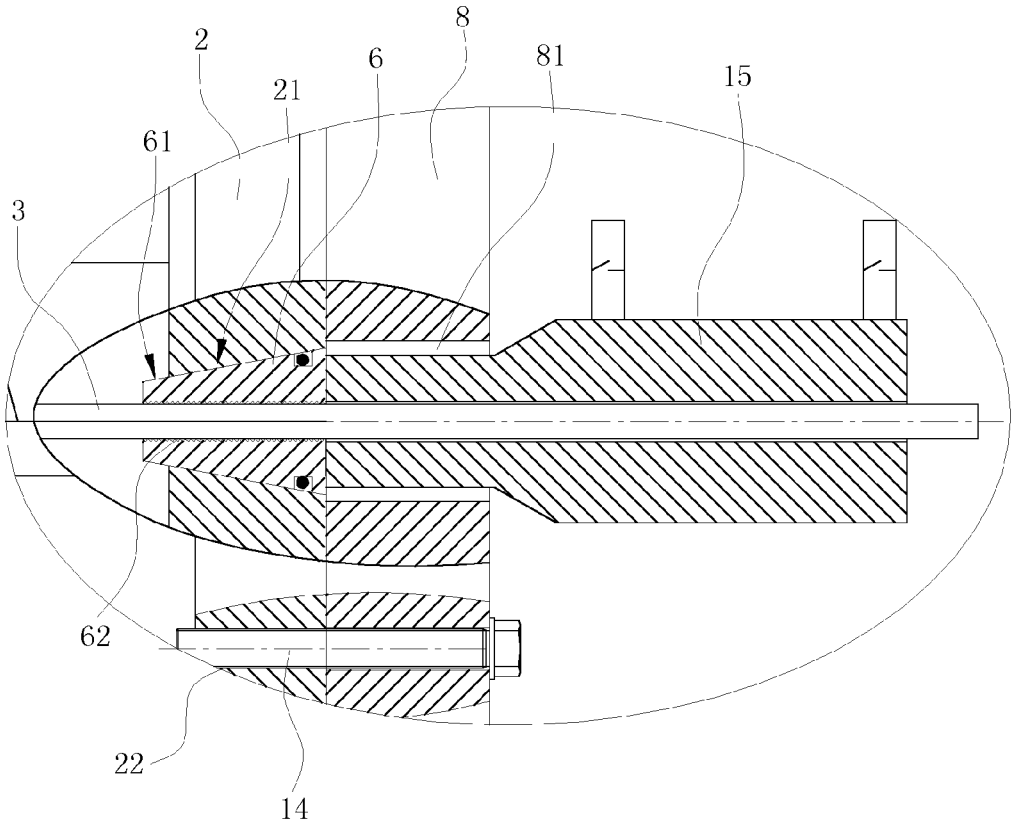
FIG. 12 is an enlarged view of Part-E of FIG. 11.
Figure 13:
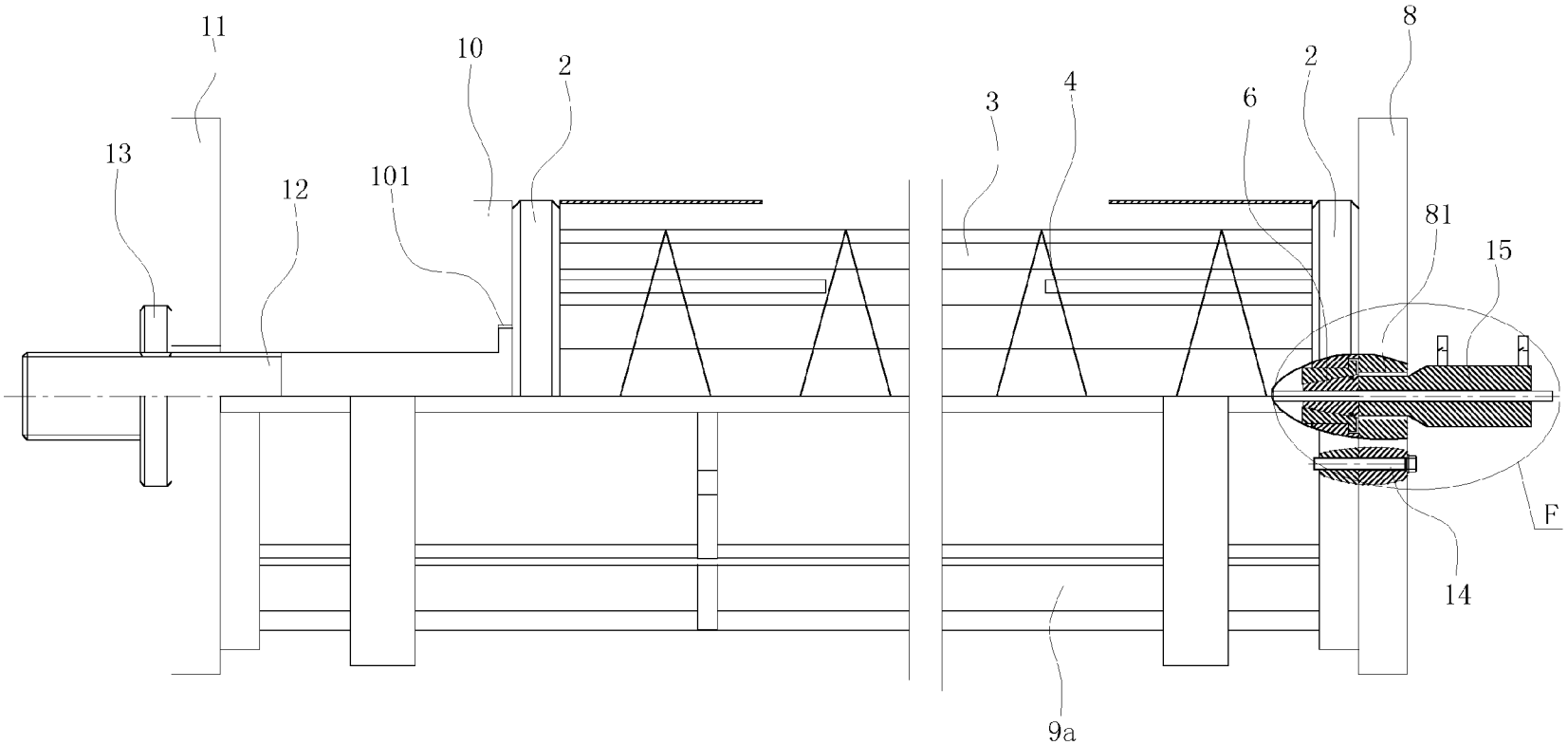
FIG. 13 is a plan view of a method for manufacturing the pre-tensioned centrifugal concrete pillar according to the second embodiment of the present invention mentioned above (with the upper half-die removed), with a sectional view showing the position of the second clip-type connecting mechanism in the second embodiment.
Figure 14:
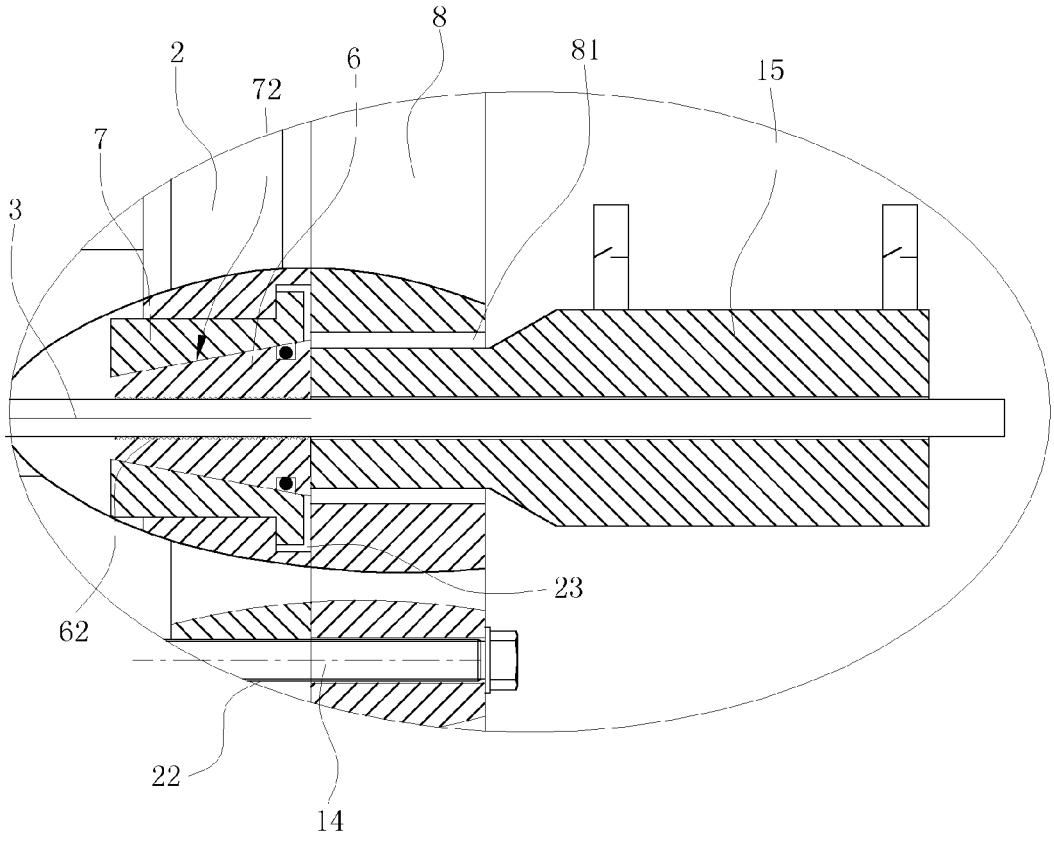
FIG. 14 is an enlarged view of Part-F of FIG. 13.
Figure 15:
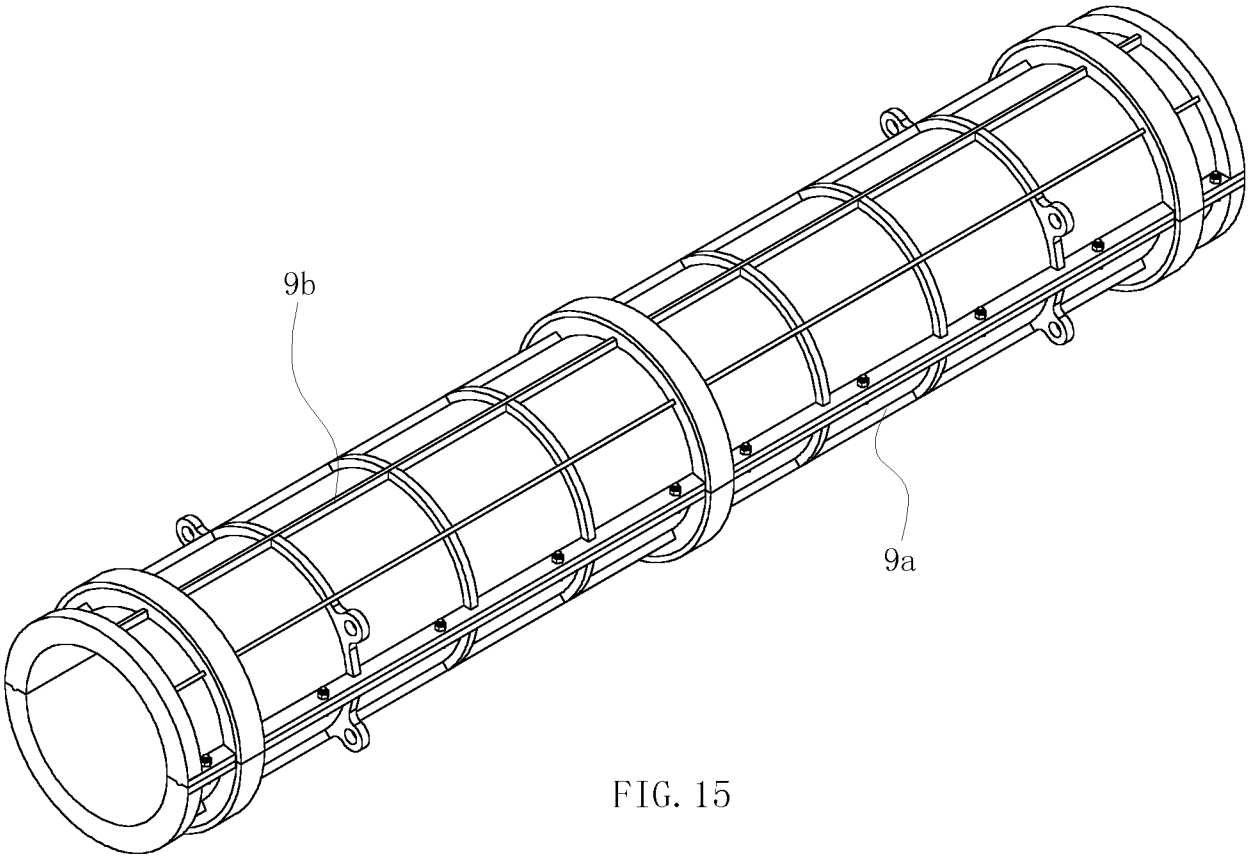
FIG. 15 is a perspective view of a die used in the two methods mentioned above.

FIG. 11 to FIG. 15 show a method for manufacturing the pre-tensioned centrifugal concrete pillar mentioned above, comprises the following steps:

(1) cutting each steel strand 3 into a predetermined length;

(2) manufacturing a steel cage;

(3) inserting each end of each steel strand 3 into a clamping hole 62 of a chuck assembly 6 inside a conical through hole 21 on a plate 2, or inside a conical transition through hole 72 of a transition element 7 on a corresponding plate 2

(4) mounting an anchor plate 8 on an outside of a first of two plates 2 through bolts 14, and mounting a tension plate 10 on an outside of a second of the two plate 2 through bolts, then, putting the steel cage into a lower half-die 9*a* with a tension plate 10 located in a die cavity of the lower half-die 9*a* and attaching the anchor plate 8 to an outside surface of one end of the lower half-die 9*a;*

(5) pouring concrete into the lower half-die 9*a*, and putting an upper half-die 9*b* onto the lower half-die 9*a;*

(6) stretching the steel cage by pulling the tension plate 10 at one end until the steel strand 3 are tensioned to a prescribed numerical value; at the same time, retracting the chuck assemblies 6 towards a small diameter of the conical through holes 21 or the conical transition through hole 72 to make each chuck assembly 6 firmly positioned inside the corresponding conical through hole 21 or the corresponding conical transition through hole 72, and clamping and locking the end of each steel strand 3 inside the clamping hole;

(7) shaping through rotating by means of centrifugal force;

(8) curing through steaming; and (9) removing the dies, and disconnecting the tension plate 10 and the anchor plate 8 from the corresponding plate 2 to release the tension.

A support plate 11, a screw stem 12 and a locknut 13 should be used in Step 6, the support plate 11 is attached to an outside surface of the other end of the die; the tension plate 8 has a counter recesses 81, and the screw stem portion of the screw stem 12 passes through the counter recess 81 and then passes through the support plate 11; and the head of the screw stem 12 is located inside the big hole portion of the counter recess 101 on the tension plate 10; the locknut 13 is coupled to the screw stem portion of the screw stem 12 and is located out of the support plate 11; and then, the screw stem 12 is pulled to pull the tension plate 8, the plate 2 and the steel strands 3, until each steel strand 3 is locked by the locknut 13 after being tensioned to a prescribed numerical value.

Preferably, a pre-tensioning step for pre-tensioning each steel strand can be added between the step 6 and the step 5, and the pre-tensioning step is an optional step, and the pre-tensioning step comprises: inserting each steel strand 3 through one of the plurality of counter bores 81 on the anchor plate; disposing a head portion of a mandrel jack 15 against the outer side surface of the chuck assembly 6, and inserting the steel strand 3 through the head portion of the mandrel jack 15, and then connecting the steel strand 3 to a traction portion of the mandrel jack 15; the traction portion of the mandrel jack 15 is not shown in the drawings, and this is the conventional structure of a mandrel jack; the steel strand 3 is withdrawn and pre-tensioned to a prescribed numerical value by the traction portion of the mandrel jack 15 so that the steel strand 3 is elongated; then, the mandrel jack 15 is removed, the steel strand 3 retracts back due to own retracting force after being elongated, and meanwhile the chuck assembly 6 is driven to move towards the small diameter of the conical through holes 21 or the conical transition holes 72, so that the chuck assembly 6 is firmly clamped inside the conical through holes 21 or the conical transition holes 72, accordingly, the steel strand 3 is further clamped and locked by the clamping hole 62 of the chuck assembly 6; a Step 10 is added after Step 9, in which the end of each steel strand 3 exposed outside of the plate 2 is cut and polished to make each steel strand 3 not exposed outside of the plate 2.

The invention claimed is:

1. A pre-tensioned centrifugal concrete pillar comprising a hollow concrete body with two ends;

a steel cage having an axis and disposed inside the concrete body, the steel cage comprises a plurality of pre-stressed rebars disposed parallel to the axis of the steel cage, a plurality of stirrups placed around the plurality of rebars; and a first plate and a second plate covering the two ends of the body, each of the first plate and the second plate has an inside facing the body and an outside facing away from the body, each plate defining a center opening;

wherein, the pre-stressed rebars are steel strands, and an end of each steel strand is connected to the first plate through a clip connecting mechanism;

the clip connecting mechanism comprises:

a plurality of conical through holes provided on the first plate, each conical through hole has a diameter increasing from the inside toward the outside of the first plate, a position of each conical through hole corresponds to each steel strand; and multiple clips disposed inside each conical through hole, each clip is composed by three conical parts with a toothed inner surface;

the multiple clips are spliced together to form a chuck assembly for clamping each steel strand, and a peripheral surface of the chuck assembly has a conical surface matching with corresponding conical through hole;

a clamping hole is formed in the center of the chuck assembly with the toothed inner surface for receiving and clamping a steel strand, the steel strand passes through a corresponding clamping hole and is clamped tightly; and an outer surface of the chuck assembly is flush with or is lower than an outer surface of the first plate.

2. The concrete pillar of claim 1, wherein each chuck assembly comprises three clips, an annular recess is formed on the peripheral surface of each chuck assembly, and a retention ring placed in the annular recess.

3. The pre-tensioned centrifugal concrete pillar of claim 1, wherein the first plate has a plurality of threaded holes for connection.

4. A pre-tensioned centrifugal concrete pillar, comprising a hollow concrete body with two ends;

a steel cage having an axis and disposed inside the concrete body, the steel cage comprises a plurality of pre-stressed rebars disposed parallel to the axis of the steel cage, a plurality of stirrups placed around the plurality of rebars; and a first plate and a second plate covering the two ends of the body, each of the first plate and the second plate has an inside facing the body and an outside facing away from the body, each plate defining a center opening;

wherein, the pre-stressed rebars are steel strands, and an end of each steel strand is connected to the first plate through a clip connecting mechanism;

the clip connecting mechanism comprises:

a plurality of counter recesses provided on the first plate;

a transition element matched with the counter recesses in dimension is disposed inside each counter recess, the transition element has an annular stop shoulder resting on the counter recess and a conical transition through hole, the conical transition through hole has a diameter increasing from the inside toward the outside of the plate and a position of each conical transition through hole corresponds to each steel strand; and multiple clips disposed inside each transition through hole, each clip is composed by three conical parts with a toothed inner surface;

the multiple clips are spliced together to form a chuck assembly for clamping each steel strand, and a peripheral surface of the chuck assembly has a conical surface matching with corresponding conical transition through hole;

a clamping hole is formed in the center of the chuck assembly with the toothed inner surface for receiving and clamping a steel strand, the steel strand passes through a corresponding clamping hole and is clamped tightly;

an outer surface of the chuck assembly is flush with or is lower than an outer surface of the first plate.

5. The concrete pillar of claim 4, wherein each chuck assembly comprises three clips, an annular recess is formed on the peripheral surface of each chuck assembly, and a retention ring placed in the annular recess.

6. The pre-tensioned centrifugal concrete pillar of claim 4, wherein the first plate has a plurality of threaded holes for connection.

* * * * *